US012459024B1

(12) United States Patent
Blaylock et al.

(10) Patent No.: US 12,459,024 B1
(45) Date of Patent: Nov. 4, 2025

(54) HYDRAULIC CONDUIT OFFSET BENDER

(71) Applicant: TEMCo Industrial, LLC, Fremont, CA (US)

(72) Inventors: Bryan C. Blaylock, Fremont, CA (US); Josh L. Leber, Fremont, CA (US)

(73) Assignee: TEMCo INDUSTRIAL, LLC, Fremont, CA (US)

( * ) Notice: Subject to any disclaimer, the term of this patent is extended or adjusted under 35 U.S.C. 154(b) by 261 days.

(21) Appl. No.: 18/224,739

(22) Filed: Jul. 21, 2023

Related U.S. Application Data

(60) Provisional application No. 63/399,444, filed on Aug. 19, 2022.

(51) Int. Cl.
*B21D 7/06* (2006.01)

(52) U.S. Cl.
CPC ..... *B21D 7/06* (2013.01)

(58) Field of Classification Search
CPC . B21D 7/06; B21D 7/063; B21D 7/14; B21D 7/022; B21D 7/024; B21D 7/021
See application file for complete search history.

(56) References Cited

U.S. PATENT DOCUMENTS 3,124,192 A 3/1964 Williams et al.
6,418,773 B1 * 7/2002 Tolman ..... B21F 11/00 72/388
11,103,910 B1 * 8/2021 Leber ..... B21D 37/02

OTHER PUBLICATIONS

Greenlee Hand Bender 1810 & 1811 Parts List.

* cited by examiner

*Primary Examiner* — Teresa M Ekiert
(74) *Attorney, Agent, or Firm* — Donald J. Ersler

(57) ABSTRACT

A hydraulic conduit offset bender preferably includes an alignment base, an upper die, a lower die, a load bearing plate, a load bearing pin and an actuation device. The alignment base preferably includes a base plate, a first upright plate and a second upright plate. The upper die preferably includes an upper die base and two load bearing spring lugs extending from opposing sides. Upper offset grooves are formed in a top and bottom of the upper die base. The lower die preferably includes a lower die base and two spring lugs extend from opposing sides. Lower offset grooves are formed in a top and bottom of the lower die base. A load bearing plate extends from the actuation device for contact with the four load bearing spring lugs. The load bearing pin is inserted through a top of the first and second upright plates to retain the actuation device.

19 Claims, 5 Drawing Sheets

HYDRAULIC CONDUIT OFFSET BENDER

CROSS-REFERENCES TO RELATED APPLICATIONS

This is a non-provisional patent application which claims the benefit of provisional patent application No. 63/399,444, filed on Aug. 19, 2022.

BACKGROUND OF THE INVENTION

1. Field of the Invention

The present invention relates generally to bending tools and more specifically to a hydraulic conduit offset bender, which allows a half inch or greater conduit to be offset bent with a portable tool.

2. Discussion of the Prior Art

U.S. Pat. No. 3,124,192 to Williams et al. discloses a bending device. U.S. Pat. No. 11,103,910 to Leber et al. discloses a conduit offset bender. A Greenlee model 1810 offset bender includes bending for only one size of conduit. It appears that the prior art does not disclose a portable hydraulic conduit offset bender. It is not possible to offset bend a conduit having a diameter of one inch or more with a normal hand operated conduit offset bender.

Accordingly, there is a clearly felt need in the art for a hydraulic conduit offset bender, which accommodates either a single size conduit or two different sizes of conduit for offset bending by upper and lower reversing dies; and which is portable for carrying by one person.

SUMMARY OF THE INVENTION

The present invention provides a hydraulic conduit offset bender, which allows two different conduit diameters to be bent with a single tool. The hydraulic conduit offset bender preferably includes an alignment base, an upper die, a lower die, a load bearing plate, a load bearing pin, four compression springs and an actuation device. The alignment base preferably includes at least one base plate, a first upright plate and a second upright plate. The first upright plate extends upward from one side of the at least one base plate. The second upright plate extends upward from an opposing side of the at least one base plate. A bearing hole is formed through a top of the first and second upright plates to receive the load bearing pin.

The upper die preferably includes an upper die base and four load bearing spring lugs. In a first embodiment, an upper offset groove is formed in a bottom of the upper die base to receive a conduit. In a second embodiment a first upper offset groove is formed in a bottom of the upper die base to receive a first size of conduit. A second upper offset groove is formed in a top of the upper die base to receive a second size of conduit. Two of the four load bearing spring lugs extend from one side of the upper die base and the other two load bearing spring lugs extend from an opposing side of the upper die base. In the second embodiment, a depth of a spring pocket in the load bearing spring lug is less than half a height of the load bearing spring lug to allow spring pockets to be formed in a top and bottom of the load bearing spring lug. Each spring pocket is sized to receive an outer perimeter of the compression spring. A distance between the two load bearing spring lugs on each side of the upper die base is sized to slidably receive the upright plate of the alignment base. A width of the upper die base is sized to be received between inner surfaces of the first and second upright plates.

The lower die preferably includes a lower die base and four spring lugs. In a first embodiment, a lower offset groove is formed in a top of the lower die base to receive a length of a conduit. In a second embodiment a first lower offset groove is formed in a top of the lower die base to receive a first size of conduit. A second lower offset groove is formed in a bottom of the lower die base to receive a second size of conduit. Two of the four spring lugs extend from one side of the lower die base and the other two spring lugs extend from an opposing side of the lower die base. Each spring pocket formed in each spring lug is sized to receive an outer perimeter of the compression spring. A distance between the two spring lugs on each side of the lower die base is sized to slidably receive the upright plate of the alignment base. A width of the lower die base is sized to be received between inner surfaces of the first and second upright plates.

The load bearing plate includes a pair of slots formed in opposing sides thereof. A width of the pair of slots is sized to receive a width of the first and second upright plates. A distance between the pair of slots is sized to be received between inner surfaces of the first and second upright plates. The actuation device is preferably a short stroke hydraulic cylinder, but other types of actuation devices could also be used. An actuation rod extends from a bottom of the hydraulic cylinder. The load bearing plate is bolted to an end of the actuation rod (not shown). A manual hydraulic pump is preferably used to actuate the hydraulic cylinder. The load bearing pin is inserted through the bearing hole to prevent vertical movement of the actuation device relative to the first and second upright plates.

When using the first embodiment, a user releases hydraulic pressure exerted by the hydraulic pump. The springs will force the upper and lower dies to separate from each other. A conduit is inserted between the upper and lower offset grooves. The hydraulic pump is actuated to extend the actuation rod of the hydraulic cylinder, which forces the upper die against the lower die to create an offset in the conduit. In the second embodiment, the size of the upper and lower offset grooves are changed by removing the load bearing pin from the first and second upright plates. The hydraulic cylinder, the upper die and the lower die are now removed from the alignment base. The four compression springs are removed from the upper and lower dies. The lower die is rotated 180 degrees about its lengthwise axis and reinserted into the alignment base. The four compression springs are reinserted into the four spring pockets in the lower die. The upper die is rotated 180 about its lengthwise axis and reinserted into the alignment base. The hydraulic cylinder is reinserted into the alignment base and the load bearing pin is reinserted through the bearing hole. A handle of the hydraulic pump may now be actuated to offset bend a conduit.

Accordingly, it is an object of the present invention to provide a hydraulic conduit offset bender, which accommodates either a single size conduit or two different sizes of conduit for offset bending by upper and lower reversing dies.

Finally, it is another object of the present invention to provide a hydraulic conduit offset bender, which is portable for carrying by one person.

These and additional objects, advantages, features and benefits of the present invention will become apparent from the following specification.

DETAILED DESCRIPTION OF THE PREFERRED EMBODIMENTS

Figure 1:
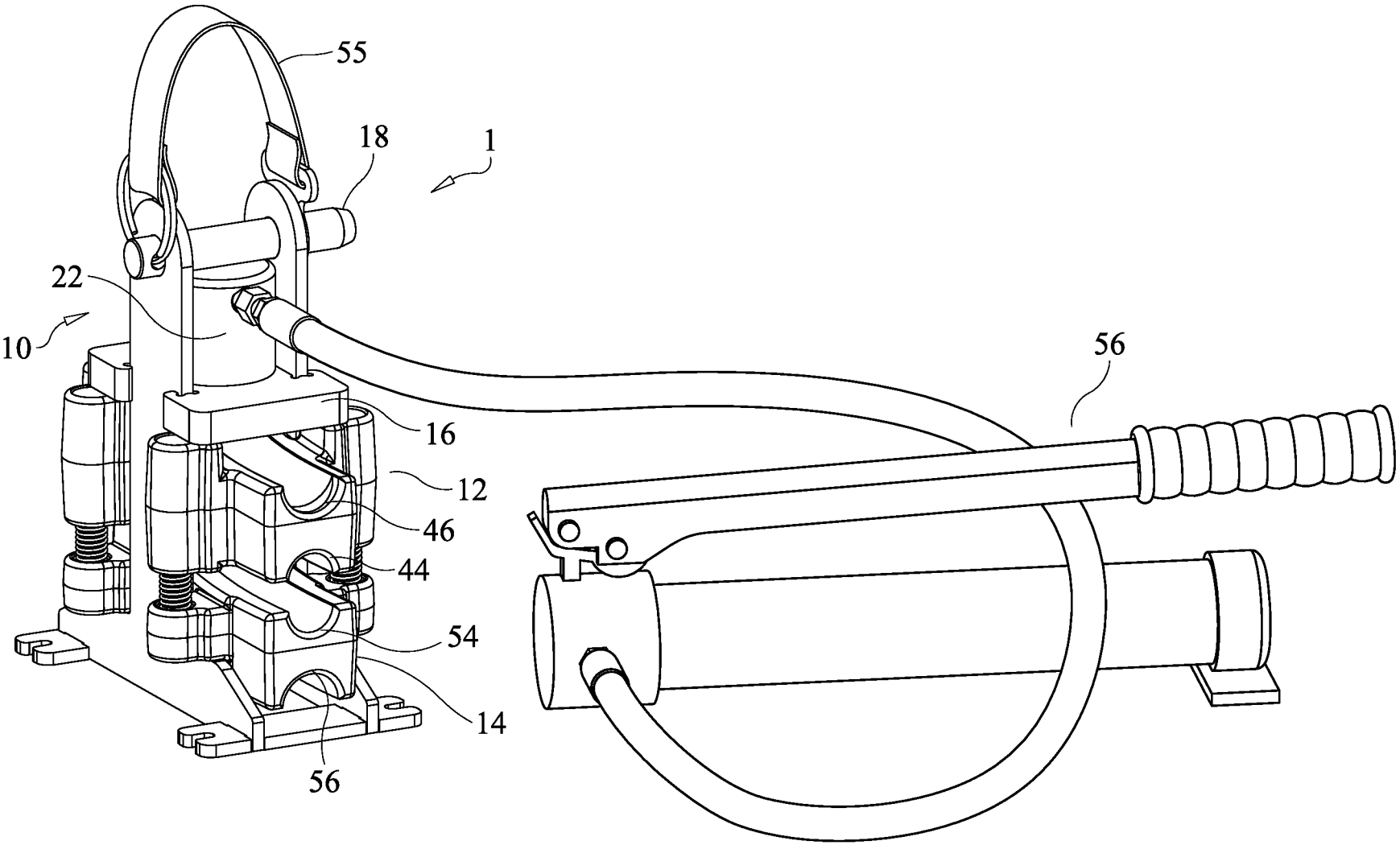
FIG. 1 is a perspective view of a second embodiment of a hydraulic conduit offset bender in accordance with the present invention.
Figure 2:
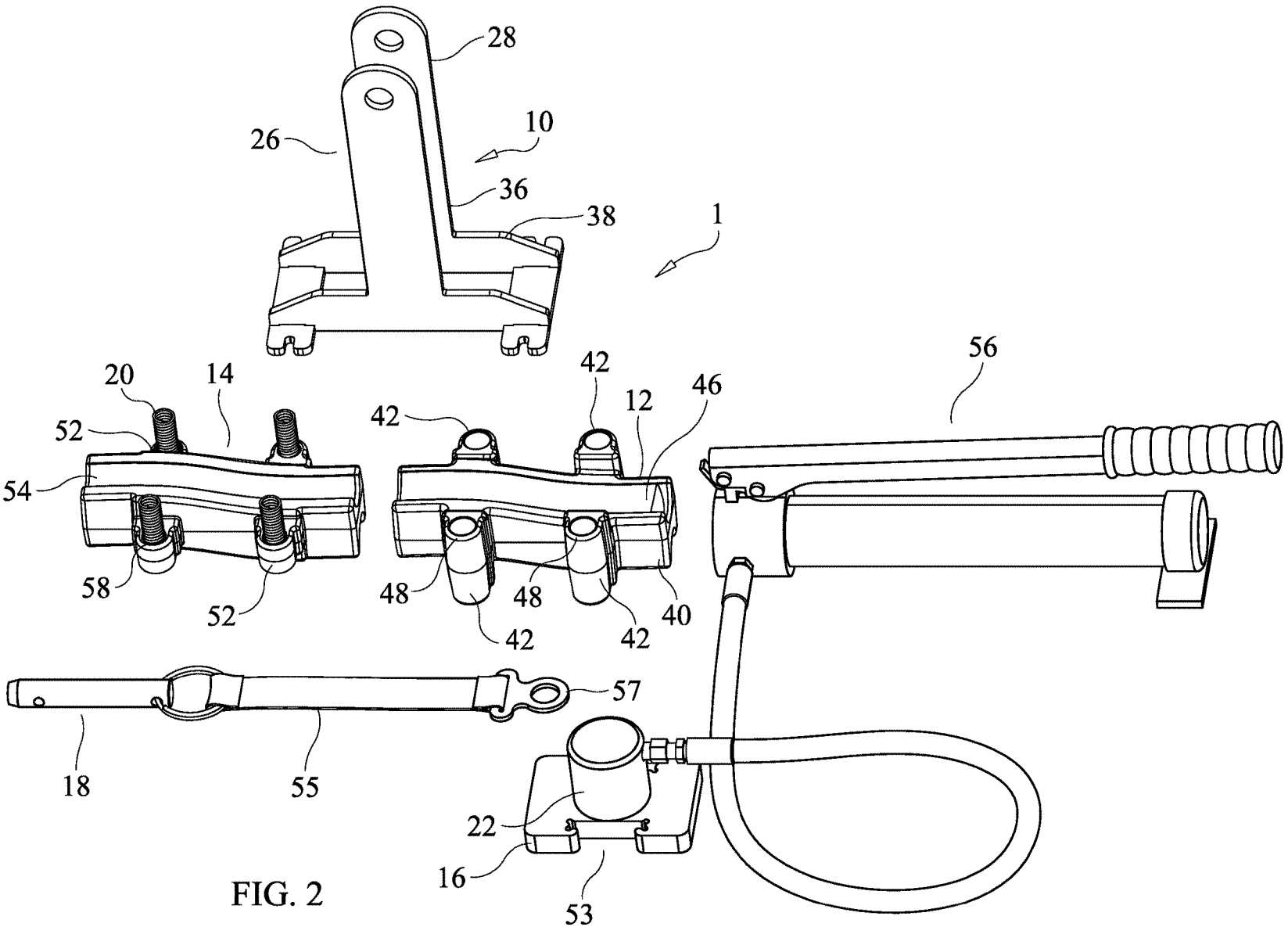
FIG. 2 is an exploded perspective view of a second embodiment of a hydraulic conduit offset bender in accordance with the present invention.
Figure 3:
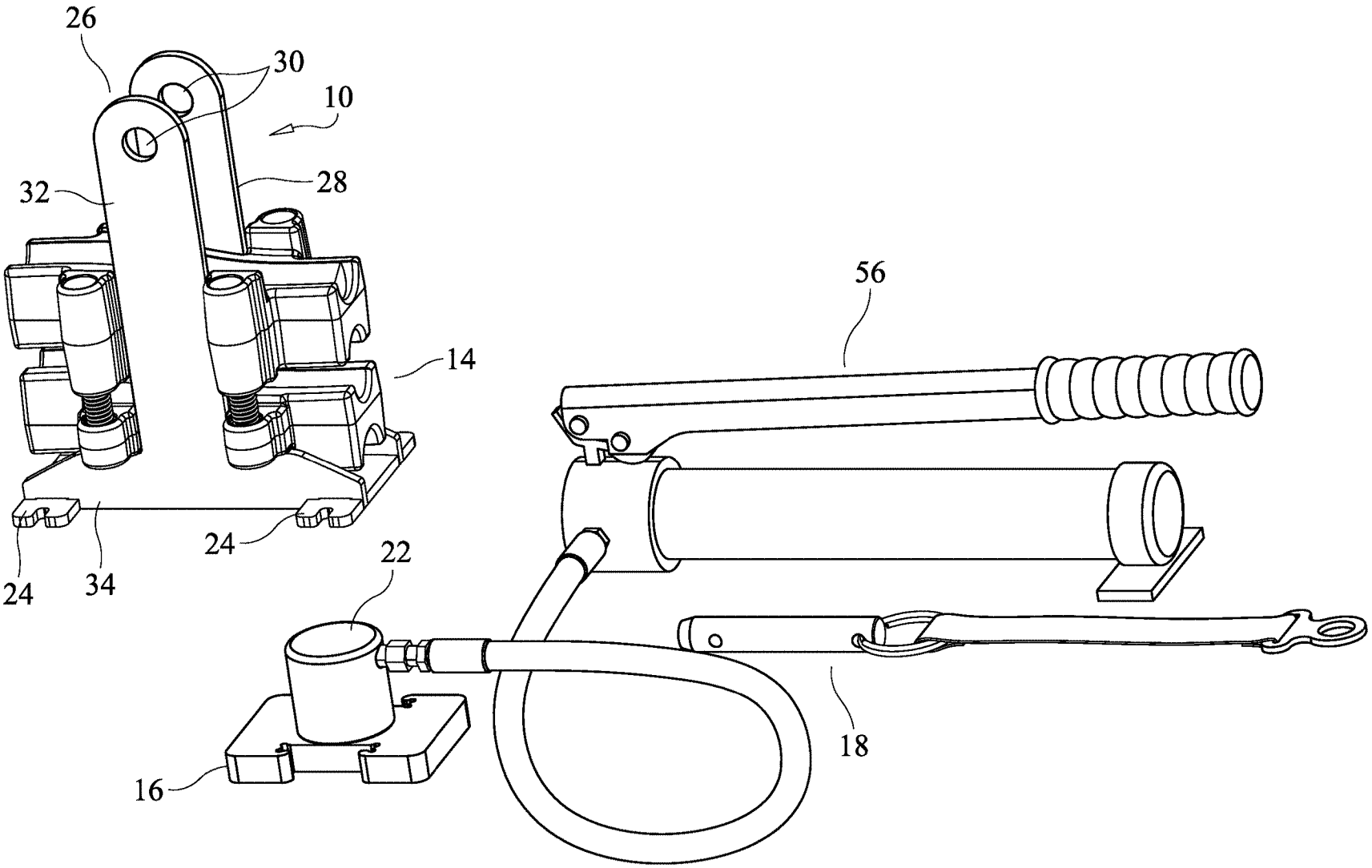
FIG. 3 is a partially exploded perspective view of a second embodiment of a hydraulic conduit offset bender with a bearing plate and actuation device removed in accordance with the present invention.
Figure 4:
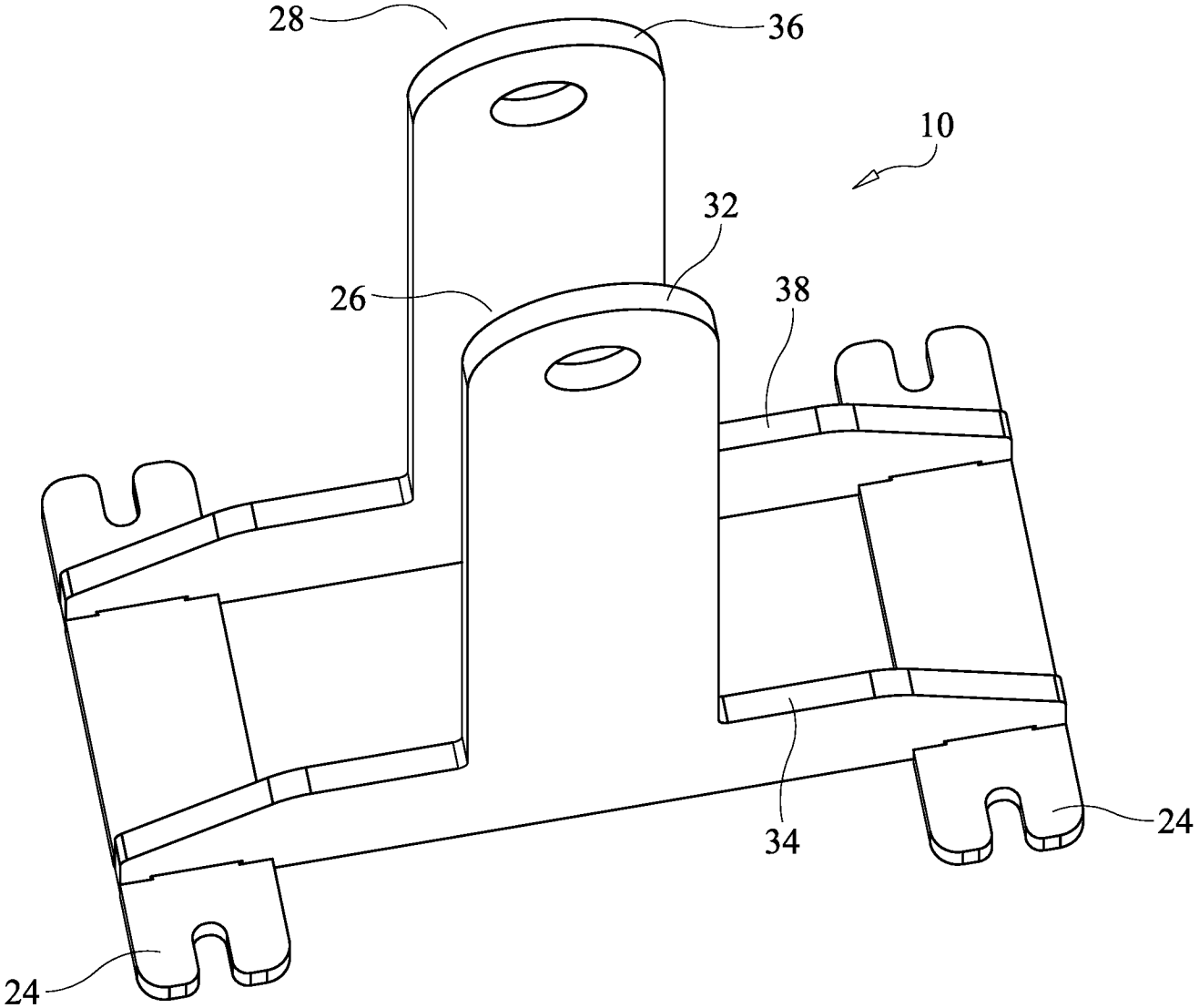
FIG. 4 is a top perspective view of an alignment base of a hydraulic conduit offset bender in accordance with the present invention.
Figure 5:
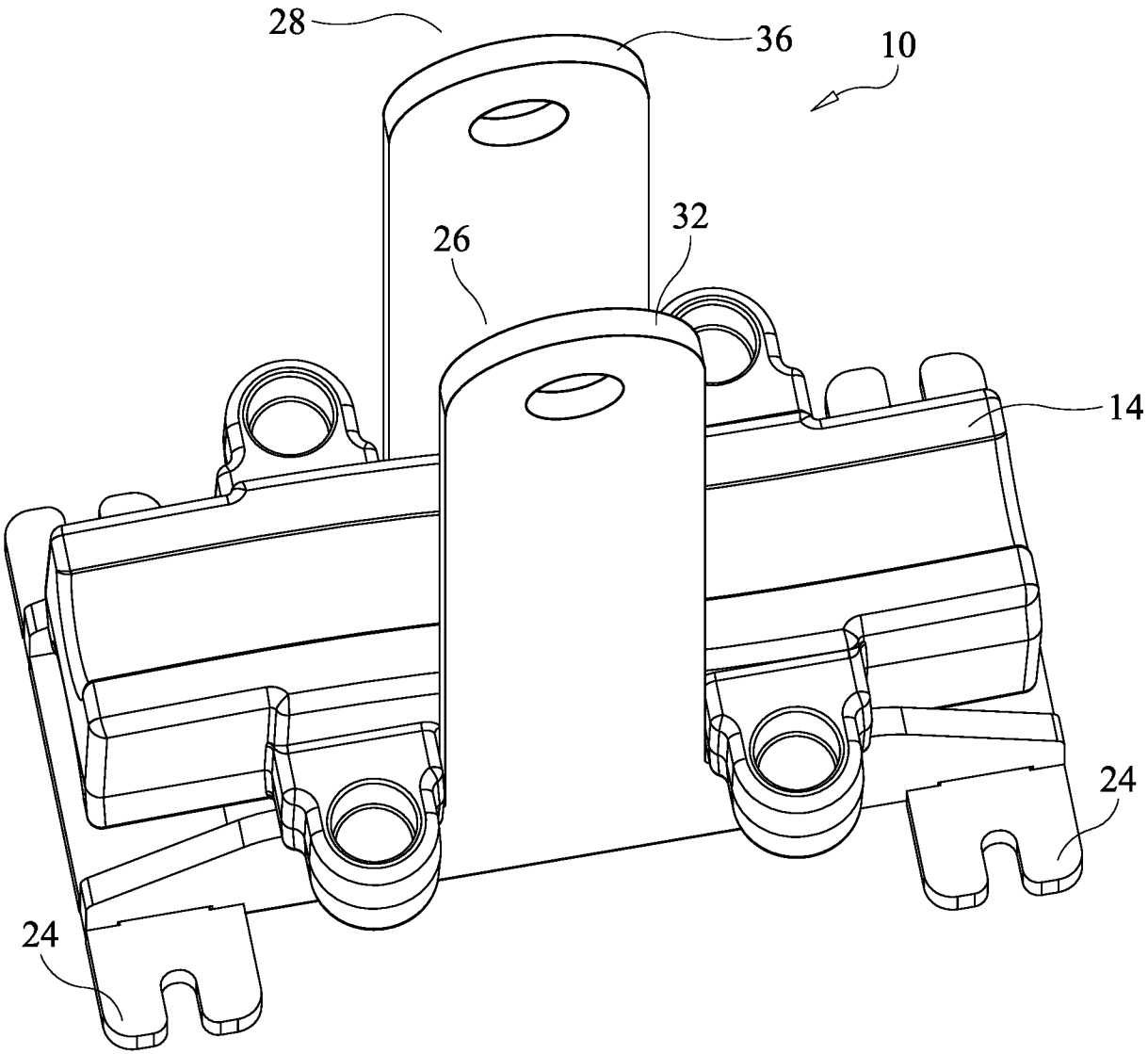
FIG. 5 is a top perspective view of a lower die retained in an alignment base of a hydraulic conduit offset bender in accordance with the present invention.

With reference now to the drawings, and particularly to FIG. 1, there is shown a hydraulic conduit offset bender 1. With reference to FIGS. 2-5, the hydraulic conduit offset bender 1 preferably includes an alignment base 10, an upper die 12, a lower die 14, a load bearing plate 16, a load bearing pin 18, four compression springs 20 and an actuation device 22. The alignment base 10 preferably includes at least one base plate 24, a first upright plate 26 and a second upright plate 28. The first upright plate 26 extends upward from one side of the at least one base plate 24. The second upright plate 28 extends upward from an opposing side of the at least one base plate 24. A bearing hole 30 is formed through a top of the first and second upright plates 26, 28 to receive the load bearing pin 18. The first upright plate 26 includes a first load bearing section 32 and a first support section 34. The second upright plate 28 includes a second load bearing section 36 and a second support section 38. The at least one base plate 24 is preferably welded to a bottom of the first and second support sections 34, 38.

The upper die 12 preferably includes an upper die base 40 and four load bearing spring lugs 42. In a first embodiment of the upper die 12, a (first) upper offset groove 44 is formed in a bottom of the upper die base 40 to receive a conduit (not shown). In a second embodiment of the upper die 12, the first upper offset groove 44 is formed in a bottom of the upper die base 40 to receive a first size of conduit. A second upper offset groove 46 is formed in a top of the upper die base 12 to receive a second size of conduit. Two of the four load bearing spring lugs 42 extend from one side of the upper die base 40 and the other two load bearing spring lugs 42 extend from an opposing side of the upper die base 40. In the second embodiment, a depth of a spring pocket 48 in the load bearing spring lug 42 is less than half a height of the load bearing spring lug 42 to allow spring pockets 48 to be formed in a top and bottom of the load bearing spring lug 42. Each spring pocket 48 is sized to receive an outer perimeter of the compression spring 20. However, the four compression springs 20 may be replaced with a different type of biasing device, such as resilient rubber or plastic. A distance between the two load bearing spring lugs 42 on each side of the upper die base 40 is sized to slidably receive the first and second load bearing sections 32, 36. A width of the upper die base 40 is sized to be received between inner surfaces of the first and second load bearing sections 32, 36.

The lower die 14 preferably includes a lower die base 50 and four spring lugs 52. In a first embodiment, a (first) lower offset groove 54 is formed in a top of the lower die base 14 to receive a conduit. In a second embodiment, the first lower offset groove 54 is formed in a top of the lower die base 50 to receive a first size of conduit. A second lower offset groove 56 is formed in a bottom of the lower die base 14 to receive a second size of conduit. Two of the four spring lugs 52 extend from one side of the lower die base 50 and the other two spring lugs 52 extend from an opposing side of the lower die base 50. A spring pocket 58 is formed in each spring lug 52 to receive an outer perimeter of the compression spring 20. A distance between the two spring lugs 52 on each side of the lower die base 50 is sized to slidably receive the first and second load bearing sections 32, 36 of the alignment base 10. A width of the lower die base 50 is sized to be received between inner surfaces of the first and second load bearing sections 32, 36.

The load bearing plate 16 includes a pair of slots 53 formed in opposing sides thereof. A width of the pair of slots is sized to receive a width of the first and second load bearing sections 32, 36. A distance between the pair of slots 53 is sized to be received between inner surfaces of the first and second load bearing sections 32, 36. The actuation device 22 is preferably a short stroke hydraulic cylinder. An actuation rod extends from a bottom of the actuation device 22. The load bearing plate 16 is bolted to an end of the actuation rod (not shown) of the actuation device. A manual hydraulic pump 56 is preferably used to actuate the hydraulic cylinder 22. The load bearing pin 18 is inserted through the bearing hole 30 to prevent vertical movement of the actuation device 22 relative to the first and second load bearing sections 32, 36. The load bearing pin 18 preferably includes a lifting strap 55 pivotally retained on one end of said load bearing pin 18. An opposing end of the lifting strap 55 includes a pin hole 57, which sized to receive a diameter of the load bearing pin 18. The hydraulic conduit offset bender 1 may lifted with the lifting strap 55.

When using the first embodiment, a user releases hydraulic pressure exerted by the hydraulic pump 56. The springs will force the upper and lower dies 12, 14 to separate from each other. A conduit is inserted between the upper and lower offset grooves 44, 54. The hydraulic pump 56 is actuated to extend the actuation rod of the actuation device 22, which forces the upper die 12 against the lower die 14 to create an offset in the conduit. In the second embodiment, the size of the upper and lower offset grooves 44, 54 are changed by removing the load bearing pin 18 from the first and second upright plates 26, 28. The hydraulic cylinder 22, the upper die 12 and the lower die 14 are now removed from the alignment base 10. The four compression springs 20 are removed from the upper and lower dies 12, 14. The lower die 14 is rotated 180 degrees about its lengthwise axis and reinserted into the alignment base 10. The four compression springs 20 are reinserted into the four spring pockets 58 in the lower die 14. The upper die 12 is rotated 180 about its lengthwise axis and reinserted into the alignment base 10. The hydraulic cylinder 22 is reinserted into the alignment base 10 and the load bearing pin 18 is reinserted through the bearing hole 30. A handle 58 of the hand pump 56 may now be actuated to offset bend a conduit.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A conduit offset bender comprising:

an alignment base includes a first upright plate and a second upright plate, a bearing hole is formed through a top of said first and second upright plates;

an upper die includes an upper die base and two upper load bearing spring lugs extending from opposing sides of said upper die base, an upper spring pocket is formed in a bottom of said two upper load bearing spring lugs, an upper offset groove is formed in a bottom of said upper die base, said upper die base is retained between inside surfaces of said first and second upright plates;

a lower die includes a lower die base and two lower spring lugs extending from opposing sides of said lower die base, a lower spring pocket is formed in a top of said two lower spring lugs, a lower offset groove is formed in a top of said lower die base, said lower die base is retained between inside surfaces of said first and second upright plates;

a load bearing plate includes a first slot formed in a first end and a second slot formed in a second end, said first and second slots at least partially enclose four sides of said first and second upright plates, respectively;

an actuation device includes an actuation rod, said load bearing plate is attached to an end of said actuation rod; and a bearing pin is inserted through said bearing hole, said actuation device and said load bearing plate are located between said upper die and said bearing pin.

2. The conduit offset bender of claim 1 wherein:

said actuation device is a hydraulic cylinder.

3. The conduit offset bender of claim 1, further comprising:

a distance between two of said four upper or lower load bearing spring lugs is sized to slidably receive a width of one of said first and second upright plates.

4. The conduit offset bender of claim 1, further comprising:

a compression spring having one end retained in said upper spring pocket, an opposing end of said compression spring is retained in said lower spring pocket.

5. The conduit offset bender of claim 1, further comprising:

a lifting strap is pivotally retained on one end of said load bearing pin, an opposing end of said lifting strap includes a pin hole which is sized to receive a diameter of said load bearing pin.

6. The conduit offset bender of claim 1 wherein:

a first support section extends from opposing sides of said first upright plate, a second support section extends from opposing sides of said second upright plate, wherein said first and second support sections support said lower die.

7. A conduit offset bender comprising:

an alignment base includes a first upright plate, second upright plate and at least one base plate, said first and second upright plates extend upward from said at least one base plate, a bearing hole is formed through a top of said first and second upright plates;

a first support section extends from opposing sides of said first upright plate, a second support section extends from opposing sides of said second upright plate, wherein said first and second support sections support said lower die;

an upper die includes an upper die base and two upper load bearing spring lugs extending from opposing sides of said upper die base, an upper spring pocket is formed in a bottom of said two upper load bearing spring lugs, an upper offset groove is formed in a bottom of said upper die base, said upper die base is retained between inside surfaces of said first and second upright plates;

a lower die includes a lower die base and two lower spring lugs extending from opposing sides of said lower die base, a lower spring pocket is formed in a top of said four two lower spring lugs, a lower offset groove is formed in a top of said lower die base, said lower die base is retained between inside surfaces of said first and second upright plates;

a load bearing plate includes a top bearing surface and a bottom bearing surface;

an actuation device includes a top actuation surface and a bottom actuation surface, said top bearing surface of said load bearing plate is in contact with said bottom actuation surface; and a bearing pin is inserted through said bearing hole, said top actuation surface is in contact with said bearing pin, said bottom being surface of said load bearing plate is in contact with said upper die.

8. The conduit offset bender of claim 7 wherein:

said actuation device is a hydraulic cylinder.

9. The conduit offset bender of claim 7, further comprising:

a distance between two of said four upper or lower load bearing spring lugs is sized to slidably receive a width of one of said first and second upright plates.

10. The conduit offset bender of claim 7, further comprising:

a compression spring having one end retained in said upper spring pocket, an opposing end of said compression spring is retained in said lower spring pocket.

11. The conduit offset bender of claim 7 wherein:

said load bearing plate includes a pair of slots formed in opposing sides thereof, a width of said pair of slots is sized to receive a width of said first and second upright plates, a distance between said pair of slots is sized to be received between inner surfaces of said first and second load bearing plates.

12. The conduit offset bender of claim 7, further comprising:

a lifting strap is pivotally retained on one end of said load bearing pin, an opposing end of said lifting strap includes a pin hole which is sized to receive a diameter of said load bearing pin.

13. A conduit offset bender comprising:

an alignment base includes a first upright plate and a second upright plate, a bearing hole is formed through a top of said first and second upright plates;

an upper die includes an upper die base and two load bearing spring lugs extending from opposing sides of said upper die base, a first upper offset groove is formed in a bottom of said upper die base, a second upper offset grove is formed in a top of said upper die base, said upper die base is retained between inside surfaces of said first and second upright plates;

a lower die includes a lower die base and two spring lugs extending from opposing sides of said lower die base, a first lower offset groove is formed in a top of said lower die base, a second lower offset grove is formed in a bottom of said lower die base, said lower die base is retained between inside surfaces of said first and second upright plates;

a load bearing plate;

an actuation device includes an actuation rod, said load bearing plate is attached to an end of said actuation rod; and a bearing pin is inserted through said bearing hole, said actuation device and said load bearing plate are located between said upper die and said bearing pin; and a lifting strap is pivotally retained on one end of said load bearing pin, an opposing end of said lifting strap includes a pin hole which is sized to receive a diameter of said load bearing pin.

14. The conduit offset bender of claim 13 wherein:

said actuation device is a hydraulic cylinder.

15. The conduit offset bender of claim 13, further comprising:

a distance between two of said four upper or lower load bearing spring lugs is sized to slidably receive a width of one of said first and second upright plates.

16. The conduit offset bender of claim 13, further comprising:

a compression spring having one end retained in said upper spring pocket, an opposing end of said compression spring is retained in said lower spring pocket.

17. The conduit offset bender of claim 13 wherein:

said load bearing plate includes a pair of slots formed in opposing sides thereof, a width of said pair of slots is sized to receive a width of said first and second upright plates, a distance between said pair of slots is sized to be received between inner surfaces of said first and second load bearing plates.

18. The conduit offset bender of claim 13, further comprising:

a lifting strap is pivotally retained on one end of said load bearing pin, an opposing end of said lifting strap includes a pin hole which is sized to receive a diameter of said load bearing pin.

19. The conduit offset bender of claim 13 wherein:

a first support section extends from opposing sides of said first upright plate, a second support section extends from opposing sides of said second upright plate, wherein said first and second support sections support said lower die.

* * * * *